US005636505A

United States Patent [19]

Havranek

[11] Patent Number: 5,636,505

[45] Date of Patent: Jun. 10, 1997

[54] OPEN-END ROTOR SPINNING DEVICE

[75] Inventor: Zdenek Havranek, Ust nad Orlici, Czech Rep.

[73] Assignee: Rieter Ingolstadt Spinnereimaschinenbau AG, Ingolstadt, Germany

[21] Appl. No.: 441,469

[22] Filed: May 15, 1995

[30] Foreign Application Priority Data

May 28, 1994 [DE] Germany ..... 44 18 723.8

[51] Int. Cl.[6] ..... D01H 4/00

[52] U.S. Cl. ..... 57/404

[58] Field of Search ..... 57/404, 406, 407, 57/416

[56] References Cited

U.S. PATENT DOCUMENTS

| | | | |
|---|---|---|---|
| 3,595,002 | 7/1971 | Korityssky et al. | 57/406 |
| 3,668,854 | 6/1972 | Le Chatelier | 57/407 |
| 3,861,132 | 1/1975 | Stahlecker et al. | 57/407 |
| 3,903,683 | 9/1975 | Shino . | |
| 3,918,248 | 11/1975 | Suzuki | 57/407 X |
| 4,245,460 | 1/1981 | Staufert et al. | 57/407 X |
| 4,278,259 | 7/1981 | Mitsuya et al. | 57/406 X |
| 4,306,166 | 12/1981 | Quandt | 57/406 X |
| 4,314,438 | 2/1982 | Miyamoto et al. | 57/406 |
| 4,633,664 | 1/1987 | Mueller-Storz et al. | 57/406 |
| 4,653,265 | 3/1987 | Stahlecker et al. | 57/406 |
| 4,653,266 | 3/1987 | Oexler et al. | 57/407 |
| 4,829,762 | 5/1989 | Wassenhoven . | |

FOREIGN PATENT DOCUMENTS

| | | |
|---|---|---|
| 2412004 | 9/1975 | Germany . |
| 2720182 | 11/1978 | Germany . |
| 4306272A1 | 9/1994 | Germany . |
| 0654551A2 | 5/1995 | United Kingdom . |

*Primary Examiner*—Michael Mansen
*Attorney, Agent, or Firm*—Dority & Manning

[57] ABSTRACT

In an open-end rotor spinning device the area of the rotor cover (3) across from the rotor edge (23) is made in the form of a rotor impact surface (4). Impact surface (4) has an axial (41) as well as a radial impact surface (42). The rotor impact surface (4) may be part of an insert (40) which is made in the form of a wearing part throughout its entire cross-section.

6 Claims, 1 Drawing Sheet

OPEN-END ROTOR SPINNING DEVICE

BACKGROUND OF THE INVENTION

The instant invention relates to an open-end rotor spinning device with a spinning rotor having a side delimited by a rotor edge, a housing containing the spinning rotor, and a rotor cover which covers the housing and the open rotor side.

In particular where supporting-ring bearings are used, but also with air bearings, the spinning rotor is not necessarily secured axially during the spinning operation. The spinning rotor is held against an axial stop, e.g. a ball, by the arrangement with supporting-rings (DE 24 12 004 A1, DE 27 20 182 A1) or by the angle at which the drive belt is guided over the rotor shaft. Due to the wearing of this ball, or also due to other inaccuracies, e.g. balance error of the spinning rotor, it happens again and again, in spite of the axial force exerted upon the rotor shaft, that the spinning rotor which rotates at a high speed comes into contact with the rotor cover and thus cuts a groove into it which is eventually so large that the rotor cover becomes unusable. However, the spinning rotor itself can also be damaged at the same time.

It has also been shown that when the spinning rotor is stopped when the drive belt is lifted off the rotor shaft, not only the thrusting function of the drive belt is put out of action, but also the thrusting function of the supporting ring is reduced due to diminished contact pressure. This increased the danger that the spinning rotor may leave its previous axial position, with the consequence that the risk of damage to the rotor cover and spinning rotor increases correspondingly.

OBJECTS AND SUMMARY OF THE INVENTION

It is therefore a principal object of the instant invention to design an open-end rotor spinning device so that a replacement of the spinning rotor and/or of the rotor cover because of wear is not necessary. Additional objects and advantages of the invention will be set forth in part in the following description, or may be obvious from the description, or may be learned through practice of the invention.

The objects are attained through the invention in that in an open-end rotor spinning device of this type, the area of the rotor cover across from the rotor edge is made in the form of a rotor impact surface. Here different possibilities for the configuration of the rotor impact surface exist. This rotor impact surface may for example be so hard, and at the same time so smooth, that when the rotating spinning rotor comes into contact with that surface, it has no perceptible effect on the spinning rotor nor on the part of the rotor cover made in the form of a rotor impact surface. This part of the rotor cover which constitutes the rotor impact surface may possess such wear resistance that the life of the rotor cover is not significantly shorter than the life of the entire open-end spinning device.

Due to balance error or due to the interrupted contact pressure of the drive belt against the rotor shaft when the spinning rotor is stopped, the latter may, among other things, execute a lateral movement in addition to an axial movement. In an advantageous further development of the invention, in order to prevent the spinning rotor in this case from making excessively wide lateral movements, it is possible to provide for the rotor impact surface to be subdivided into an axial and a radial impact surface.

It has been explained above that the rotor impact surface can be made as a wear-resistant and smooth surface. In an advantageous alternative embodiment of the invention it is however also possible for the rotor impact surface to be part of a wearing part which is made of a softer material than that of which the spinning rotor is made. To avoid having to replace the entire rotor cover when this wearing part is worn, the rotor impact surface is advantageously part of an insert.

In an advantageous embodiment of the invention the insert is made as a wearing part throughout its entire cross-section. This makes it possible to grind the surface of the insert smooth again from time to time, and thus to extend the life of the insert.

In an alternative embodiment of the device according to the invention, the insert is provided with a carrier which carries the wearing part.

The insert is preferably replaceable so that it may be replaced by a new insert when it has been worn out.

In an advantageous embodiment of the invention, the wearing part is made in the form of a coating and consists of a synthetic resin polymer sold under the Trademark "TEFLON", for example.

Often a rotor spinning device is designed so that it is able to accept spinning rotors of different diameters at will. In such a case, where a spinning rotor of a given diameter can be replaced by one with another diameter, it is preferable if a separate insert is provided in the rotor cover for each of the insertable rotor diameters. If a separate insert is provided in the rotor cover, or if a common insert is provided in the rotor cover for each of the insertable rotor diameters, the insert should extend over the range of diameters of all the rotor diameters that may be used.

The invention can be used in the most different types of rotor spinning devices, independently of whether an outside negative-pressure source is provided, or whether or not the spinning rotor itself produces the negative pressure required for spinning. For the protection of the rotor cover and/or of the spinning rotor, no space-consuming or expensive device is needed. It suffices for merely the part of the rotor cover across from the rotor edge to be made in the form of a rotor impact surface. Depending on whether it is more desirable to extend the life of the spinning rotor or that of the rotor cover or even of both elements, this rotor impact surface is made in the form of a wear-proof surface or in the form of a wearing surface. As needed, the rotor impact surface can be made as an integral component of the rotor cover or as part of an insert which in turn may be connected to the rotor cover in a permanent manner or so that it can be replaced. Since the rotor impact surface is either part of the rotor cover or is supported indirectly by the same, it suffices to exchange the existing rotor cover against one designed according to the invention in order to realize the instant invention in an open-end rotor spinning device which is already completed.

BRIEF DESCRIPTION OF THE DRAWINGS

Embodiments of the invention shall be explained in further detail through the single FIG. 1 which shows a schematic cross-section through a rotor spinning device made in accordance with the invention.

DETAILED DESCRIPTION OF THE PREFERRED EMBODIMENTS

Figure 1:
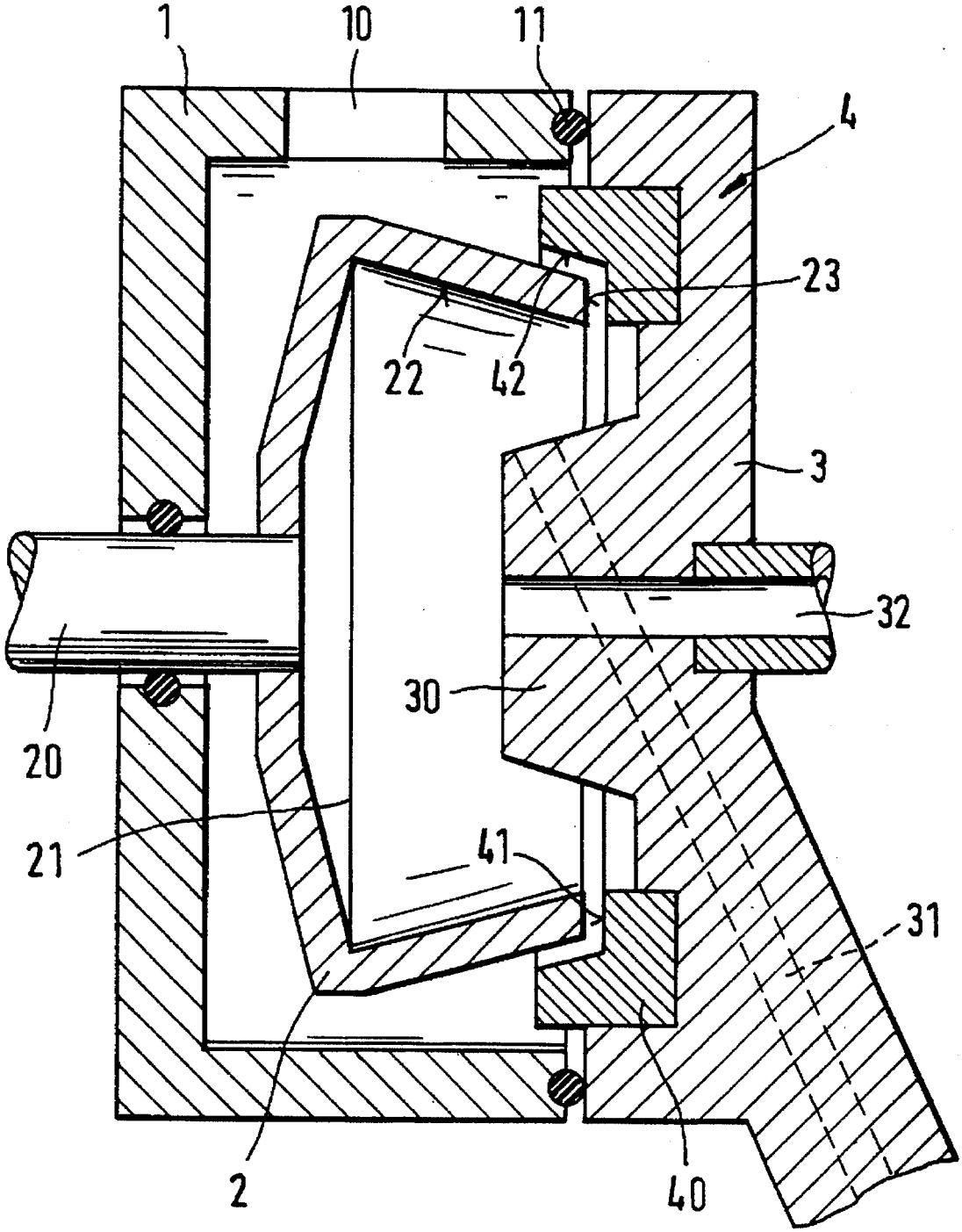

Reference will now be made in detail to the presently preferred embodiments of the invention, one or more examples of which are illustrated in the drawings. Each example is provided by way of explanation of the invention, and not as a limitation of the invention. In fact, it will be apparent to those skilled in the art that various modifications and variations can be made in the present invention without departing from the scope and spirit of the invention.

Referring to FIG. 1, a housing 1 is connected in a known manner via an opening 10 to a source of negative pressure serving to produce the negative spinning pressure. Housing 1 has a spinning rotor 2 which extends with its shaft 20 through a face of housing 1 to the outside and is supported and driven outside of housing 1 in a known manner.

The spinning rotor 2 is provided with a gliding wall 22 which ends in a collection groove 21, the gliding wall extending from the open rotor edge 23 to the collection groove 21.

In the known operating position, the open side of the housing 1, as well as the open side of the spinning rotor 2, are covered by means of a rotor cover 3 which presses in this position against housing 1, whereby a ring seal 11 ensures tightness between the rotor cover 3 and the housing 1.

The rotor cover 3 is provided with an extension 30 extending into the inside of the spinning rotor 2, whereby the end of a fiber feeding channel 31 and the inlet opening of a yarn draw-off channel 32 are located in said extension 30.

In the area across from the rotor edge 23, the rotor cover is provided with a rotor impact surface 4. This rotor impact surface is part of an insert 40 and is made of a material which is softer than the material of which the spinning rotor 2 is made. The insert 40 supporting the rotor impact surface 4 is thus a wearing part, as shall be explained in further detail below.

During normal operation fibers are fed in a known manner through the fiber feeding channel 31 to the gliding wall 22 of the spinning rotor 2, along which they glide into the fiber collection groove 21 where they form a fiber ring. The end of a yarn is in contact with this fiber ring and is being withdrawn continuously through the fiber draw-off channel 32 by the usual means, incorporating in this process the continuously forming fiber ring.

During operation, the spinning rotor 2 rotates at high speed, whereby a drive belt (not shown) presses on its shaft 20 and pushes it against supporting-rings which are placed across the shaft in a crossed manner so that they hold the spinning rotor 2 away from the rotor cover 3 in contact with an axial bearing (not shown). The balance error in the spinning rotor 2, or wear of the ball in the axial bearing, causes the spinning rotor 2 to execute axial movements against the effect of the supporting-rings and the drive belt, coming at least briefly into contact with the rotor cover 3 during these movements. Since the rotor cover 3 is made in the form of a rotor impact surface 4 in the area where the rotor edge 23 may come into contact with the rotor cover 3, damage is avoided. Depending on the design of the rotor impact surface, damages are either an unacceptable wearing of the spinning rotor 2, or else of the rotor cover 3.

If it is wished to avoid wear of the faces of the spinning rotor 2 (rotor edge 23), the rotor impact surface should be made of a soft material which is softer than the material of which the spinning rotor 2 is made. If the spinning rotor 2 thus comes to bear on the rotor impact surface 4 with its rotor edge 23, the rotor impact surface 4 coming into contact with the spinning rotor 2 is subjected to wear.

In the embodiment shown, the rotor impact surface 4 is made as part of an insert 40 which can be replaced as needed, i.e. after heavy wear. For this purpose the insert 40 is connected in a suitable manner to the rotor cover 3. This connection may be effected by screwing it into threads (not shown) in the rotor cover 3 or also by cementing or glueing it in. Other types of attachment, e.g. by means of a snap connection (bayonet lock) and similar devices are also possible.

A number of different materials which are otherwise also suitable for slide bearings can be used as the material, e.g. many synthetic materials, bronze-sintered metals, etc.

In the shown embodiment, the insert 40 is made as a wearing part throughout its entire cross-section. This has the advantage that the insert 40 can be ground down in case of uneven wear, so that a perfect surface is again available as the rotor impact surface 4.

Due to balance error etc., the spinning rotor 2 not only executes axial movements but also radial movements, among others. For this reason the shown rotor impact surface 4 is provided with an axial impact surface 41 to intercept axial rotor movements as well as a radial impact surface 42 to intercept radial rotor movements.

The invention is not limited to the shown design but can be varied in many ways, e.g. by exchanging individual elements with equivalents or through other, not shown combination of the different elements. Thus it is not absolutely necessary—as indicated earlier—that the rotor impact surface 4 be made of a material that is softer than the material of the spinning rotor 2. In such a case, the rotor impact surface 4 is not designed as a wearing surface, but is on the contrary wear-resistant. This wear-resistant material is extremely hard and has a smooth surface, so that the spinning rotor 2 does not suffer any damage when it runs up against this rotor impact surface 4. Due to the smooth surface of the rotor impact surface 4, the wear on the rotor edge 23 is negligible. Even if the spinning rotor 2 is worn to some extent at the rotor edge 23, this does not generally lead to any disadvantage.

It is also not absolutely necessary for the rotor impact surface 4 to be made as part of the insert. Instead it is absolutely possible to make part of the rotor cover 3 in the form of a rotor impact surface 4 so that the rotor impact surface 4 constitutes an integral part of the rotor cover 3. Depending on the type of material selected for the rotor cover 3, it may be sufficient if the corresponding area of the rotor cover 3 is given a hardened and smooth surface through appropriate treatment. It is also possible to provide this area of the rotor cover 3 with a coating which advantageously imparts special hardness to this area if it is provided on the rotor cover 3 itself. If an insert 40 is provided, it may also be equipped with a carrying element which carries the wearing part. In such case, this wearing part can be made in the form of an element attached to the carrier or in the form of a coating. In case of an insert 40, the coating may consist of a dry-gliding bearing material and thus lower the friction between the spinning rotor 2 and the rotor cover 3. Teflon for example is a suitable coating, but other materials, in particular various synthetic materials and sintered metals, are well-suited for this.

It is not absolutely necessary that the rotor impact surface 4 be provided also with a radial impact surface 42 in addition to the axial impact surface 41, whether or not it is an integral part of the rotor cover 3 or part of an insert 40. The impact surface 42 may be omitted if it is possible to prevent the spinning rotor 2 from executing excessively wide radial movements as said spinning rotor 2 is being stopped.

The rotor impact surface 4 in the form of an integral part of the rotor cover 3, or in the form of an insert 40, can also be used if the rotor cover 3 is made as a carrier of a fiber gliding surface on which the fibers are fed from the fiber feeding channel 31, to be fed only from this fiber gliding surface into the spinning rotor 2. It does not matter in that case whether the rotor impact surface 4 is located directly on the rotor cover 3 or indirectly, by being provided on the body supported by the rotor cover 3 which receives the fiber gliding surface preceding the spinning rotor 2.

Although this has not been mentioned above, the rotor impact surface 4 should extend over the entire circumference of the rotor cover 23 across from the rotor so that in case of an impact of the spinning rotor 2, uniform support of same is ensured and so that shocks may be avoided. For this reason one or several balls or roller elements, arranged in a circle corresponding to the rotor edge 23, are unsuitable because they would be exposed to strong shocks due to the possibly impacting spinning rotor, as said shocks would be leading in turn to damage of the roller elements and then even more to damage of the spinning rotor 2 and/or the rotor cover 3.

In practice, the housing 1 of an open-end spinning device is often designed so that spinning rotors 2 of different diameters and forms may be used at will. If it is not necessary for this to replace the rotor cover 3 in adaptation to the spinning rotor 2 which is being put to use, the area on such a rotor cover 3 suitable for several rotor diameters which can interact with the rotor edge 23 of a spinning rotor 2 of one or the other size can be designed as a common insert. This does not, however, exclude the possibility of providing a separate insert for each of the possible rotor sizes.

Although this was not mentioned especially above, it goes without saying that the form of the radial impact surface 42 must be adapted to the outer contours of the spinning rotor 2. An additional positive effect can be achieved in that case by designing the radial impact surface so that a large portion of the outer contours of the spinning rotor 2 is covered, so that the air friction of the spinning rotor can be decreased in order to save drive energy. The radial impact surface extends especially advantageously in that case from the rotor edge 23 to the area of the outer contour which, seen in axial direction, extends to the level of the collection groove 21. It is especially advantageous if the distance between the radial impact surface and the outer contour of the spinning rotor is short. A distance of 4 mm or less, preferably between 0.5 mm and 2 mm is here especially advantageous. Care must be taken that the conveying air of the fibers can still be evacuated from the spinning rotor in case that this is done over the rotor edge 23.

Even if the device has been described above only in connection with supporting rings, the invention is not limited to this. Other bearings allowing for an axial and/or radial movement, e.g. air bearings, can also be used in connection with the above-described rotor impact surface 4. Depending on the life of the insert 40, the latter can be made so as to be replaceable or so that it cannot be separated from the rotor cover 3, or from a carrier of a fiber gliding surface supported by it.

It should be apparent to those skilled in the art that various modifications and variations can be made in the present invention without departing from the scope and spirit of the invention. For example, features illustrated or described as part of one embodiment can be used on another embodiment to yield a still further embodiment. It is intended that the present invention cover such modifications and variations as come within the scope of the appended claims and their equivalents.

I claim:

1. An open-end spinning device, comprising a spinning rotor on an end of a rotor shaft having an open side delimited by a rotor edge, said spinning rotor formed of a first material having a first hardness characteristic, a rotor housing in which said spinning rotor is housed, and a rotor cover covering said housing and disposed opposite said open side, said rotor cover further comprising a rotor impact material carried therein in an area generally opposite said rotor edge, said spinning rotor mounted axially within said rotor housing so as to move axially to contact said rotor impact material during spinning operations, said rotor impact material defining a non-compressible rotor impact surface having a hardness characteristic different from said hardness characteristic of said first material so as to minimize wear of said rotor edge.

2. The device as in claim 1, wherein said rotor impact surface comprises an axial section extending axially away from said rotor edge and a radial impact section extending generally parallel to said rotor edge.

3. The device as in claim 1, wherein said hardness characteristic of said rotor impact surface is less than that of said first material.

4. The device as in claim 3, wherein said rotor impact material is formed of a softer material than said first material throughout its entire cross section.

5. The device as in claim 1, wherein said rotor impact material is formed as a replaceable insert member removably fixed to said rotor cover.

6. The device as in claim 5, wherein said replaceable insert member comprises a radial impact surface section extending generally parallel to said rotor edge so as to be compatible with said varying size spinning rotors.

* * * * *